United States Patent [19]

Sullivan

[11] Patent Number: 4,522,106

[45] Date of Patent: Jun. 11, 1985

[54] GUN HAMMER MECHANISM

[75] Inventor: James L. Sullivan, Costa Mesa, Calif.

[73] Assignee: Chartered Industries of Singapore Private Limited, Jurong Town, Singapore

[21] Appl. No.: 436,383

[22] Filed: Oct. 25, 1982

[30] Foreign Application Priority Data

Oct. 30, 1981 [GB] United Kingdom ..... 8132812

[51] Int. Cl.[3] ..... F41C 5/00; F41C 19/00; F41D 11/02

[52] U.S. Cl. ..... 89/140; 89/154; 42/69 B

[58] Field of Search ..... 89/132, 151, 154, 194–197, 89/139, 140, 141, 142; 42/20, 69 B

[56] References Cited

U.S. PATENT DOCUMENTS

| | | | |
|---|---|---|---|
| 2,377,703 | 6/1945 | Loomis | 42/22 |
| 2,401,616 | 6/1946 | Clarke | 89/154 |
| 2,571,132 | 10/1951 | Harvey | 89/154 X |
| 3,489,060 | 1/1970 | Marocchi | 89/197 X |

FOREIGN PATENT DOCUMENTS

| | | | |
|---|---|---|---|
| 2002633 | 2/1969 | France . | |
| 594713 | 6/1959 | Italy | 89/132 |
| 217867 | 12/1967 | Sweden | 89/132 |
| 873475 | 7/1957 | United Kingdom . | |
| 2109515 | 6/1983 | United Kingdom | 89/142 |

*Primary Examiner*—Stephen C. Bentley
*Assistant Examiner*—John S. Maples
*Attorney, Agent, or Firm*—Ladas & Parry

[57] ABSTRACT

A hammer mechanism for an automatic gun has a hammer 742 connected to rotate about a pivot rod 741 and the hammer has a firing pin striking surface 743. A strut 750 is connected by a pivot 752 to the remote side of the firing pin striking surface 743 from the hammer pivot 741 and the opposing end of the strut 750 from the hammer is spring biassed to rotate the hammer toward a firing position. The top surface of the strut 753 is arranged to be tangential to a top surface on the hammer defining a radius 744 so as to enable a block 300 of the bolt carrier assembly 3 to ride completely rearwardly of the hammer and not to foul thereupon on its forward portion of the bolt operating cycle.

10 Claims, 5 Drawing Figures

GUN HAMMER MECHANISM

Figure 1:
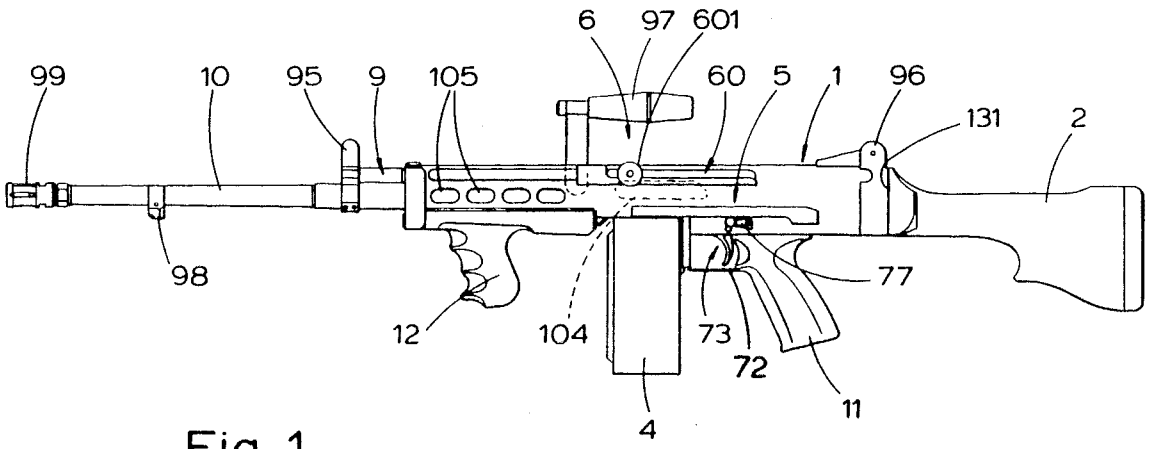

This invention relates to an automatic or semi-automatic gun hammer mechanism.

Automatic guns are well known and the term is applied to a gun in which, when a trigger is pulled, a plurality of cartridges are fired serially for as long as the trigger is held or until the last cartridge is fired. Semi-automatic guns are similarly well known and the term is usually applied to a gun which, when a trigger is pulled, fires a cartridge, subsequently ejects the cartridge, cocks the bolt and chambers a next cartridge automatically but does not fire the said next cartridge until the trigger is released, before being again pulled to again repeat the cycle. Automatic and semi-automatic guns are generally of three different kinds namely, recoil operated, blow back operated or gas operated and the present invention principally relates to the latter form of operation.

One known form of gas operated automatic or semi-automatic gun employing a hammer mechanism is the Garand rifle various forms of which are described in Janes Infantry Weapons, 1980–1981, 6th Edition, edited by Colonel John Weeks published by Janes Publishing Company at pages 183–186. A gas operated automatic or fully automatic gun such as the 0.30 M1 carbine has a receiver housing a bolt/bolt carrier assembly which is urged toward a barrel by a drive spring. In travelling forwardly the bolt/bolt carrier assembly strips and feeds a cartridge from a magazine into a feed area within the receiver and the bolt drives the cartridge over a feed ramp within the normally provided barrel extension to chamber the cartridge. The bolt is usually then rotated into a locked position so that the cartridge is securely held within the chamber. When the trigger is pulled the hammer is released from captivity of a sear and under spring pressure the hammer is rotated about a pivot to drive a firing pin into the cap of the cartridge. Gas produced by the firing action of the cartridge enters a radial drilling positioned at a predetermined distance along the length of the barrel and once the bullet has passed the drilling, gas enters a cylinder whilst the bullet is still in the barrel. Once the bullet leaves the barrel the gas is dissipated. The cylinder houses a piston which operates under the cartridge gas pressure and as the cylinder fills with gas so the piston is driven rearwardly to drive an operating slide which acquires the momentum of the piston such that the operating slide rotates and unlocks the bolt. Continued movement of the operating slide causes the bolt/bolt carrier assembly to travel rearwardly thereby extracting and ejecting the cartridge and starting the cocking action on the hammer. Completion of rearward movement of the bolt-/bolt carrier assembly cocks the hammer and the main drive spring of the bolt/bolt carrier assembly is compressed to again drive the bolt forwardly. The bolt chambers the next round and rotates the bolt to the locked position and the operating slide pushes the piston forwardly inside its cylinder so that the weapon is again ready to fire.

In some guns with pivotally mounted swinging hammers the hammer is driven by a coiled torsion spring or by a leaf spring although with such a simple spring the hammer suffers from the disadvantage that the torsion spring applies its load to the hammer with increased force when fully cocked. Thus, a high drag friction force is applied to the sliding bolt/bolt assembly. To overcome this disadvantage the M1 Garand rifle uses a hammer strut in combination with a compression spring with the strut being connected to the hammer intermediate the hammer pivot and the firing pin striking surface of the hammer. The strut is located within the coil spring and the coil spring is mounted inside a tubular sleeve, the end of the sleeve remote from the hammer being pivotally connected to the trigger. The advantage of such a spring loaded strut is that it applies its force linearly and the direction of its force can be arranged so that when the spring force is greatest (i.e., in the cocked position) the force is directed primarily toward the hammer pivot pin instead of upwardly against the sliding, reciprocal, bolt/bolt carrier assembly. Thus, it will now be understood that the disadvantage of a hammer operated by a torsion spring is that the torsion spring applies its greatest friction when the bolt is sliding over the hammer but that with a hammer operated by a strut the strut and associated compression spring applies its lowest friction drag when the bolt is sliding over the hammer.

In an automatic or semi-automatic gun the bolt/bolt carrier assembly cycle time is very fast, approximately one tenth second, and the time for a carriage to rise from a magazine into the feed area within the receiver is only a fraction of that bolt cycle time since the time for the cartridge to rise can commence only once the bolt-/bolt carrier assembly has overtravelled the rear of the cartridge. Thus, if the bolt overtravels the rear of a cartridge in the magazine by only a short distance the time available for the cartridge to rise is extremely short so that consequently a strong magazine spring to move cartridges to the feed throat must be used. However, if a large capacity magazine is employed, for example, fifty rounds or more, then the magazine spring must be made even stronger so as to move the mass of cartridges in the limited time available for a cartridge to rise into the path of a reciprocating bolt/bolt carrier assembly. The stronger the spring force however, the greater is the frictional resistance met by the bolt/bolt carrier assembly in driving the top most cartridge out of the magazine feed throat, which frictional resistance must be overcome by the bolt/bolt carrier assembly drive spring, with the result that the reliability of the gun is decreased. The present invention seeks to provide a hammer mechanism and a gun employing the same in which a large capacity magazine can be used but in which a weaker magazine spring force than heretobefore can be employed.

According to one aspect of this invention there is provided a hammer mechanism for an automatic or semi-automatic gun including a hammer connected to rotate about a pivot, a firing pin striking surface on the hammer and, on the remote side of the firing pin striking surface from the pivot, a pivotable strut connected to a bias means, whereby the strut is arranged to be contacted by a normally provided reciprocal bolt means of the gun to permit the bolt means to travel entirely rearwardly of the hammer and to cock the hammer with the strut holding the hammer out of the forward path of the bolt means to enable the bolt means to travel forwardly and thereby strip and chamber a further cartridge.

In the currently preferred embodiment the side of the hammer remote from the pivot has a surface defining a radius extending through an approximate quadrant and the strut is mounted on the hammer so that the upper, bolt means contacting surface thereof is substantially tangential to said radius.

By arranging the strut to be contacted by the bolt means it is possible for the bolt means to completely overtravel the hammer since the connection between the strut and the hammer is such that the hammer, when the bolt means is travelling forwardly, is held out of the path of the bolt. In the known guns having a pivotable hammer the hammer is recocked by the rearward motion of the bolt and after the hammer has been forced to swing rearwardly and downwardly so as to compress the hammer spring, so the bolt travels onto the top of the hammer and holds it down. In the prior art gun designs utilsing a swinging hammer, the rearward motion of the bolt means is limited, by impacting against a rear wall or buffer, so that the bolt means does not overtravel the hammer arc since if it did the hammer would swing upwardly slightly until caught by a trigger sear and would block the return of the bolt. Thus, in the known art, the cartridge rise time is limited by the bolt-/bolt carrier assembly overtravel distance which is in turn limited when a swinging hammer is used.

In distinction, the present invention utilises a hammer strut in which the strut is contacted by the bolt/bolt carrier assembly as the bolt travels rearwardly and that as the bolt travels beyond the arc described by the rotation of the hammer so the bolt/bolt carrier assembly rides along the contact surface of the hammer strut. In this manner the strut is held downwardly which in turn holds the hammer downwardly out of the forward path of the bolt/bolt carrier assembly. As the bolt returns forwardly it is able to pass smoothly over the surface defining a radius on the hammer which is tangent to the contact surface on the strut. The allowable bolt travel distance is thereby able to meet the requirement of magazine feed time instead of the mechanical requirement of the hammer so that the limitation introduced by the prior art is overcome and a considerable technical advance is produced.

Normally a pivotably mounted trigger is connected to a sear having a lip for engaging with a corner on the hammer, the corner on the hammer being intermediate the respective pivots of the hammer and strut, whereby the lip and corner are arranged so that when the hammer is released the sear holds the hammer in a non-firing position and when the trigger is pulled the sear releases the hammer which is then urged by the bias means to a firing position. Conveniently the trigger is integral with the sear.

Preferably a latch is pivotally mounted on the trigger pivot, the latch having one surface arranged to abut the trigger, a further surface arranged to holdingly engage the hammer and a biassing means urging said one surface to be rotated into abutting relationship with the trigger. Advantageously, the biassing means is a compression spring.

Conveniently said further surface is hook shaped to engage with a receiving recess in the hammer. Advantageously the receiving recess in the hammer is located between said corner and the strut pivot.

Advantageously, the trigger and latch each have a respective tail portion located rearwardly on their common pivotable mounting and a compression spring is mounted in the tail portion of the trigger to extend toward the tail portion of the latch for exerting rotational effort thereupon.

Preferably the bias means comprises a tube pivotably mounted at an end remote from the hammer, a compression spring inside the tube having one end thereof abutting the tube pivot, a shank at the end of the strut remote from the hammer, the shank extending inside the compression spring, and a stop surface at the confluence of the shank and the strut against which the end of the compression spring remote from the tube exerts force, whereby the force of the compression spring urges the shank to be reciprocable within the tube to rotate the hammer.

According to a further aspect of this invention there is provided an automatic or semi-automatic gun having a reciprocable bolt means and a hammer mechanism which comprises a hammer connected to rotate about a pivot, a firing pin striking surface on the hammer, and on the remote side of the firing pin striking surface from the pivot a pivotable strut connected to a bias means, whereby the strut is arranged to be contacted by the bolt means to permit the rearward movement of the bolt means to travel entirely rearwardly of the hammer to cock the hammer with the strut holding the hammer out of the forward path of the bolt means to enable the bolt means to travel forwardly and thereby strip and chamber a further cartridge.

The terms "forward" and "rearward" and similar adverbial phrases used herein are used in relation to the gun muzzle so that, for example, the buttstock is positioned rearwardly of the muzzle.

Figure 2:
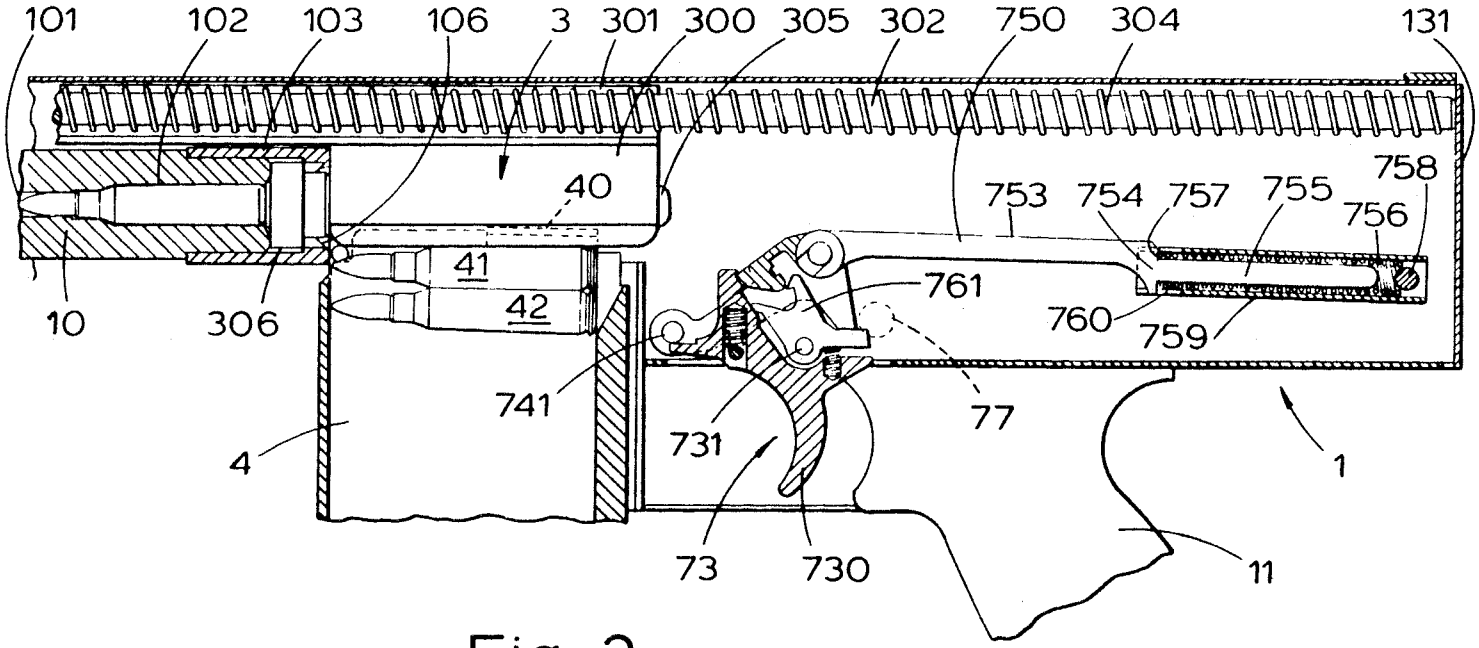
Figure 2A:
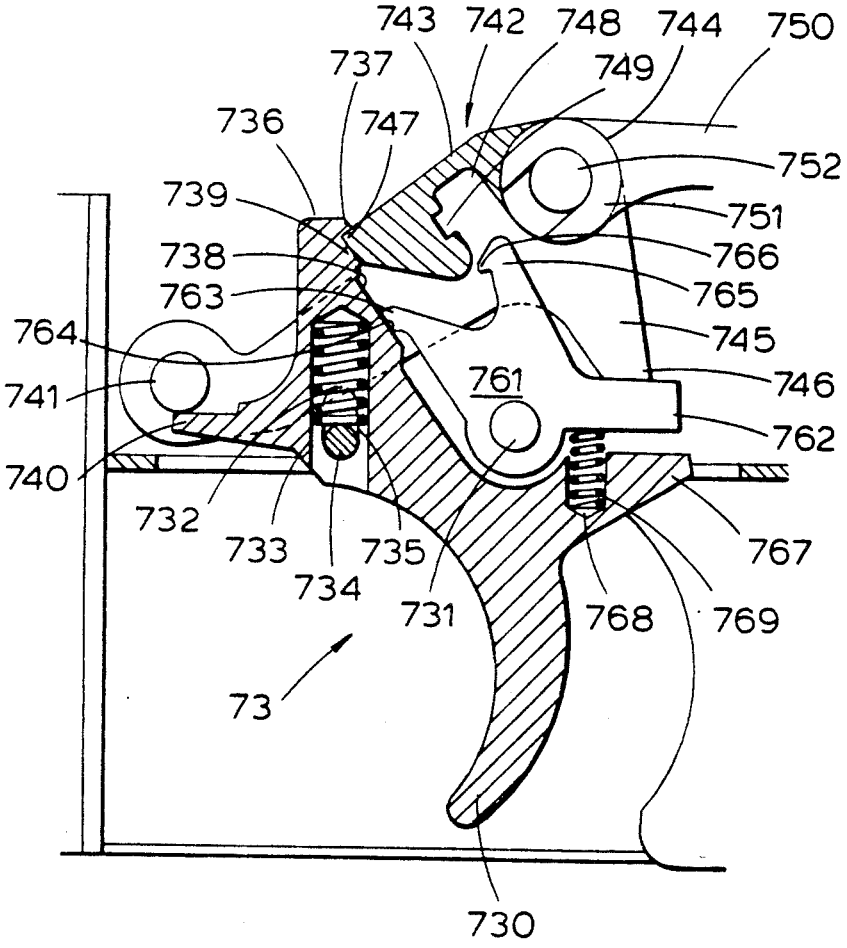
Figure 3:
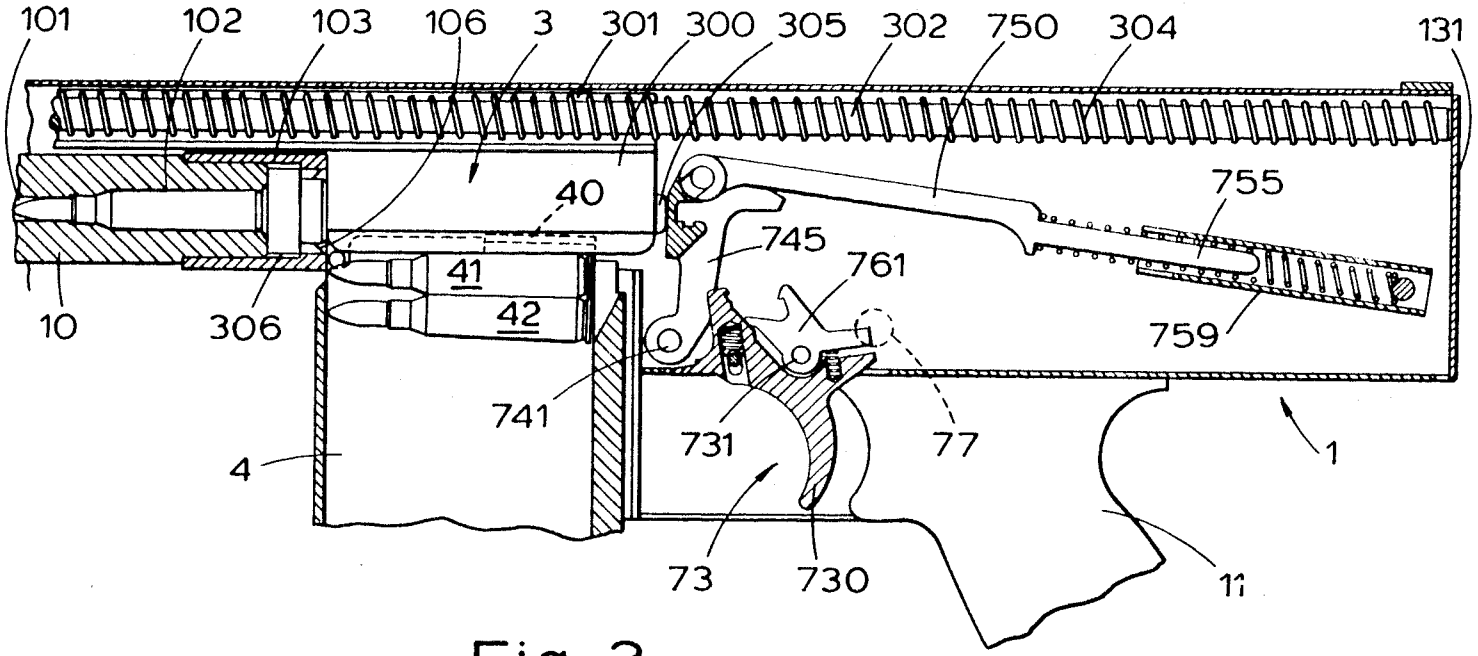
Figure 4:
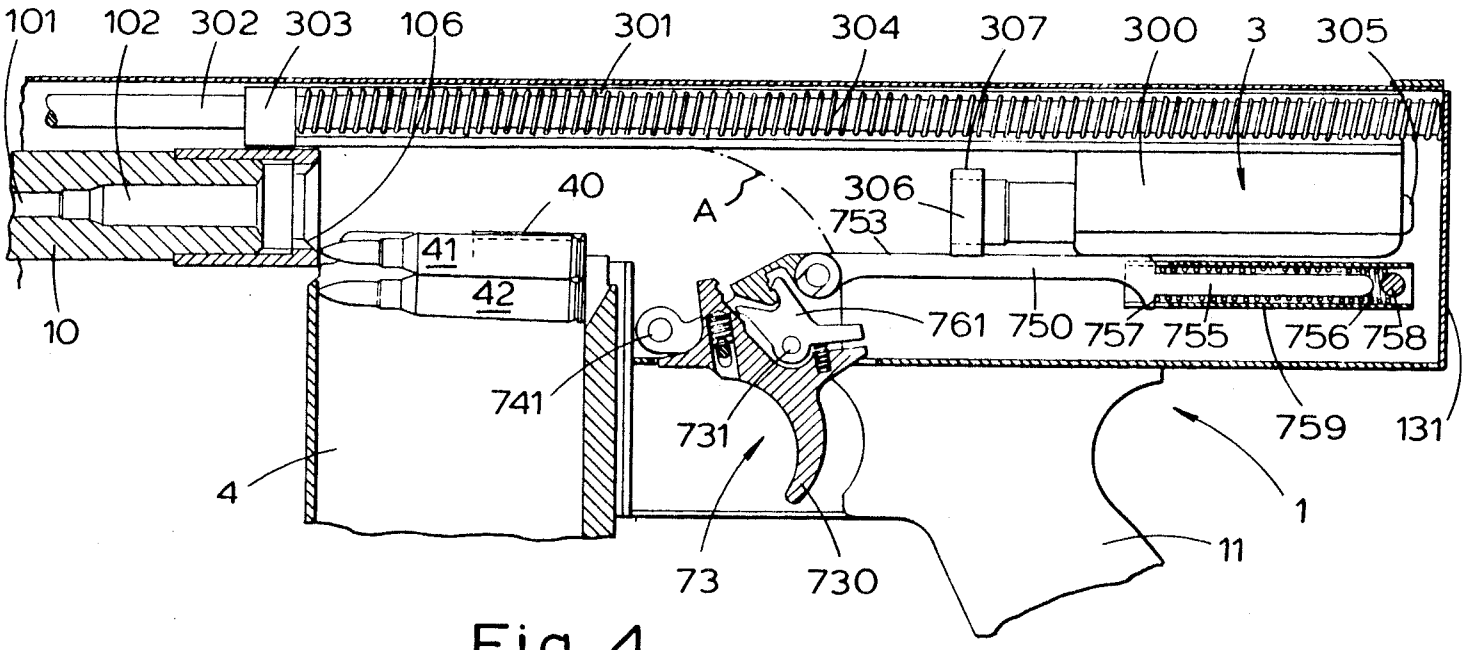

The invention will now be described by way of example with reference to the accompanying drawings in which:

FIG. 1 shows a left hand side view of a gas operated gun in accordance with this invention drawn to a reduced scale in comparison with the remaining figures, FIG. 2 is a longitudinally sectioned part view of the gun shown in FIG. 1 with the bolt carrier assembly forwardly, the trigger released and the hammer cocked, FIG. 2A is an enlarged view of part of FIG. 2, FIG. 3 is a similar view to FIG. 2 but with the bolt carrier assembly forwardly, the trigger pulled and the hammer in a firing position, FIG. 4 is a similar view to FIGS. 2 and 3 but with the bolt carrier assembly at its rearmost position with the trigger pulled.

In the Figures like reference numerals denote like parts.

The gas operated automatic or semi-automatic gun shown in FIG. 1 has a receiver 1 to the rear wall channel 131 of which is connected a buttstock 2 and at the opposite end of the receiver 1 from the buttstock 2 there is connected a barrel 10. A pistol grip 11 is connected by a screw and nut (not shown) underneath the receiver 1 and a foregrip 12 is connected by screws (not shown) to the underside of the barrel 10. The pistol grip is connected to the receiver 1 through the intermediary of a trigger guard 72 shrouding a trigger assembly 73 having a rotatable sear actuator (safety catch and firing mode selector) 77.

Mounted in the bottom well of the receiver 1 is a cartridge magazine 4 which is of the drum type although it may be a flat box type magazine. The magazine 4 may be that described in our copending U.K. Application No.: 8039745 and is held to the receiver by a magazine latch assembly 5.

A cocking handle assembly 6 is mounted on the left hand side of the receiver incorporating a cocking bar sub-assembly 60 and including a cocking handle 601, the cocking bar sub-assembly being connected to a bolt carrier assembly 3 (shown in FIGS. 2-4). Mounted on the top rear of the receiver 1 is a rear sight 96 and on the right hand side of the receiver is a carrying handle 97.

Also on the right hand side of the receiver is a cartridge ejector slot 104 and in both sides of the front of the receiver are provided four cooling apertures 105 to assist in removing heat from the rear end of the barrel 10. A gas system 9 is connected between the front of the receiver 1 and the foresight assembly 95. A bayonet lug attachment 98 is provided on the barrel and at the muzzle there is a flash suppressor 99.

Referring now to FIGS. 2, 2A, 3 and 4, the trigger assembly 73 has an arcuate finger pull trigger 730 pivotally mounted on a rod 731, the trigger 730 being biassed by a compression spring 732 enclosed in a blind hole 733 situated in an upstanding head 736 of the trigger 730, one end of the spring 732 acting against the closure of the blind hole 733 and the other end of the spring acting against a trigger spring retainer 734 which is a stationarily positioned rod mounted in the receiver 1. The retainer 734 is located in a guide slot 735 in the trigger to permit the trigger to move arcuately. The trigger has a tail 767 located rearwardly of the rod 731 and located in a blind hole 768 in the tail is a compression spring 769. The head 736 which is integral with the trigger has a rearwardly facing hook forming a sear 737 and planar surface 738 below the sear has a projection 739. The trigger further has a forwardly projecting nose 740 arranged to abut the underside of a rod 741 about which a hammer 742 rotates.

The hammer 742 has a firing pin striking surface 743 and a surface defining a radius 744 located above the firing pin striking surface 743. The surface defining a radius 744 extends through an approximate quadrant and the hammer is an approximate L shape with the base 745 of the L being downwardly extending to a foot 746 for preventing excessive downward travel of the hammer. The hammer is formed to have a perpendicular corner 747 which cooperates with the lip shaped sear 737 with one of the sides forming the corner 747 abutting the projection 739. Rearwardly of the firing pin striking surface 743 is provided an aperture 748 extending perpendicularly to the firing pin striking surface 743. The aperture 748 has a recess 749 extending substantially parallel to the firing pin striking surface for cooperation with a hook on a latch to be described hereinafter. On the remote side of the firing pin striking surface and of the aperture 748 from the pivot rod 741 is a strut 750 having at one end thereof a fork 751 which pivotally locates around a circularly cross-sectioned rod 752 at the upper extremity of the hammer 742. The location of the strut 750 is arranged so that an upper surface 753 of the rod 750 forms a tangent to the radial surface 744 on the hammer.

The end of the strut 750 remote from the fork 751 terminates in a foot 754 from which extends a shank 755. The shank 755 is slidingly located within a compression coil spring 756, the coil spring 756 being restrained between a stop surface 757 at the confluence of the strut 750 and shank 755 and a pivot 758 mouhted between the side walls of the receiver 1. Housing the spring 756 and pivotally mounted on the pivot 758 is a tube 759 having at its end remote from the pivot 758 a vertical slot 760 to accommodate the foot 754.

Secured on the same pivot rod 731 of the trigger is a latch 761 having a tail 762 the underside of which is acted upon by the spring 769. The latch 761 has a forward, curved, finger 763, the tip 764 of which is arranged to abut the planar surface 738 on the rearwardly facing part of the head of the trigger.

The latch 761 also has a rearwardly disposed finger 765 at the tip of which is a hook 766 which is shaped and arranged to engage with the recess 749 in the hammer.

The barrel 10 has a bore 101, a firing chamber 102 and a barrel extension member 103 for connecting the barrel to the receiver. The barrel extension member 103 has an internal feed ramp 106 so as to assist cartridges 41, 42 in the magazine 4 to travel into the chamber 102 and locking lugs (not shown) for locking the bolt to the barrel extension.

The bolt carrier assembly 3 is slidably mounted upon a rail (not shown) in the receiver 1 and the bolt carrier assembly comprises a block 300 which is suitably shaped to contact with the rail and secured to the top of the block, for example, by welding is a support member 301 for a drive spring rod 302, the rod 302 passing through a block 303 containing a bearing surface (shown in FIG. 4) which is secured to the support member 301. Circumferentially surrounding the rod 302 between the block 303 and the rear wall 131 of the receiver is a main drive spring 304, which is a compression spring arranged to urge the block 303 to the left as shown in the figures so that the bolt carrier assembly is urged under spring tension toward the barrel extension member 103.

Mounted on the longitudinal axis of the barrel and inside the block 300 is a firing pin 305 which is biassed in a rearward direction by a compression spring (not shown). Encompassing the front portion of the firing pin is a bolt 306 having radial locking lugs 307 for engaging between and subsequently locating behind corresponding locking lugs in the barrel extension member 103. The bolt 306 is conventionally provided with a cam pin (not shown) which cooperates in a known manner with a cam slot (also not shown) in the left hand side (looking forwardly) of the block 300. Further, the bolt 306 is provided in conventional manner with an ejector pin (not shown) and a spring biassed extractor claw (not shown) which in operation engages the cannelore of a cartridge for removal of the cartridge from the chamber 102. The bolt 306 is slidingly rotatable on the longitudinal axis of the barrel inside the block 300 so that the lugs 307 are able to interleave with the corresponding lugs on the barrel extension 103 and when the bolt is rotated by the action of the cam pin in its cooperating cam slot so the bolt lugs 307 rotate and engage behind the lugs on the barrel extension 103 thereby preventing the bolt 306 from moving in a rearwards direction until re-rotated.

The cartridges in the magazine are urged by a spring (not shown) toward a feed throat 40 in the top of the magazine 4 having a passage sufficiently wide to allow the bottom of the bolt to pass therethrough but too narrow to allow the upper cartridge 41 to escape so that the feed throat limits the upward movement of the cartridges and aligns the upper cartridge in a position in readiness for feeding it to the chamber. Thus, a cartridge is able to escape from the feed throat 40 only by being slid in a forwards direction by the bolt 306 up the feed ramp 106 and into the chamber 102.

In operation, referring to FIG. 2, the position of the components has assumed that the bolt carrier assembly 3 has been drawn rearwardly by the cocking handle 601 so that the bottom surface of the block 300 has rotated the hammer 742 about its pivot rod 741 in a clockwise direction until the corner 747 on the hammer has engaged with the lip of the sear 737. The hammer is thus cocked and the trigger is released, i.e. forward, and the bolt carrier assembly 3 has been manually pushed forwardly to strip a top most cartridge from the magazine 4 and has chambered the cartridge in the chamber 102. In chambering the cartridge the bolt lugs initially interleave the barrel extension lips and then the bolt is rotated by its cam pin and slot so that the bolt lugs are locked with the barrel extension lugs. The top most cartridge 41 in the magazine, urged by magazine spring pressure, rises to abut the underside of the block 300. With the trigger released it is biassed to its fullest clockwise position by the spring 732 acting against the retainer 734 and the closure of the blind hole 733 and the nose 740 abuts the underside of rod 741. In this position the latch 761 is rotated anti-clockwise by spring 769 acting between the closure of the blind hold 768 in the trigger and the underside of the tail 762 so that the forward finger 763 has its tip 764 abutting the planar surface 738 of the trigger. With the corner 747 held by the sear 737 the hammer, in being rotated clockwise, has compressed its coil spring 756.

Referring now to FIG. 3 the trigger finger pull 730 has been pulled rearwardly to rotate the trigger in an anti-clockwise direction against the force of spring 732. This has the result of also rotating the head 736 and consequently the sear 737 so that the corner 747 of the hammer is released. The force of spring 756 acting between the pivot 758 and stop surface 757 urges the strut 750 forwardly thereby causing the internal surfaces of the fork 751 and outer surface of the rod 752 to act as journal surfaces and to rotate the hammer in an anti-clockwise direction about pivot rod 741. The firing pin striking surface 743 thus contacts the rear of the firing pin 305. The firing pin is thereby urged in a forwards direction through the block 300 and bolt 306 to strike the rear, cap, of the cartridge in the chamber 102. The cartridge thus fires and the gases produced by the muzzle blast are fed by a tapping in the wall of the barrel through the gas system 9 to drive the block 303 and hence support member 301 and block 300 rearwardly and to thereby compress the main drive spring 304. In driving the bolt carrier assembly 3 rearwardly the bolt 306 is rotated by its cooperating cam pin around the cam slot in the block 300 to thereby unlock the lugs 307 on the bolt from the lugs in the barrel extension 103. The bolt carrier assembly thus moves rearwardly and accordingly rotates the hammer in a clockwise direction. Because the top surface 753 of the strut is tangential with the radial surface 744 on the top of the hammer, the undersurface of the block 300 smoothly rides from the hammer onto the strut 750. The continued rearward movement of the block 300 causes the strut 750 to be rotated and driven downwardly with the result that the hammer spring 756 is compressed. The rearward extent of travel of the block 300 is designed so that it does not strike the wall 131 and so that the hammer 742 travels in a clockwise direction through a greater arc, as designated by chain dotted line A in FIG. 4, than in manual cocking such that the hook 766 on the rearward finger 765 of the latch engages in the recess 749 of the hammer. The trigger is still pulled and thus rotated in an anticlockwise direction but the rotation of the hammer is such that the engagement between the hook 766 and recess 749 rotates the latch 761 in a clockwise direction against the force of spring 769. The position of the components is then as indicated in FIG. 4 with the tip 764 out of contact from the surface 738 and the cartridges having risen to the top of the feed throat 40.

The bolt carrier assembly cycles due to the compression force of the main drive spring 304 thus driving the block 303, support member 301, block 300 and bolt 306 forwardly. In moving forwardly the bolt 306 strips the top most cartridge 41 and continued movement of the bolt 306 forwardly drives the cartridge 41 over the feed ramp 106 and into the chamber 102. However, the hammer 742 remains held by the hook 766 on the latch. It will be appreciated that the bolt cycles in a very short period of time, approximately one tenth of a second and that the trigger is not released in such a short period of time. The trigger upon being released by a firer moves in a clockwise direction so that the planar surface 738 abuts the tip 764 of the latch to rotate the latch 761 in a clockwise direction thereby causing the hook 766 to move out of engagement from the recess 749. The hammer is then rotated by its spring 756 in an anti-clockwise direction so that the corner 747 engages with the sear 737. The components are then again in the position shown in FIG. 2 except that cartridge 41 is chambered and cartridge 42 has moved upwardly to abut the under surface of the block 300. The cycle of operations is ready to repeat.

It will be appreciated that the foregoing description of operation has been in regard to semi-automatic operation, i.e. single shot but with automatic chambering of a cartridge. To convert the gun to operate in a fully automatic mode the sear actuator 77 is rotated so that a portion of the actuator 77 depresses the tail 762 to render the hook 766 unable to locate in the recess 749 and the hammer automatically rotates behind the rear of the block 300 to strike the firing pin 305 for as long as the trigger is pulled and there are cartridges in the magazine 4.

Thus by providing a smooth transition between the top of the hammer and the strut's upper surface 753 it will be seen that the bolt is able to overtravel behind the hammer so that a longer time is permitted for the cartridges to rise within the magazine without the problem of the bolt fouling the rear of the hammer and not being able to continue forward movement to the barrel extension.

I claim:

1. An automatic or semi-automatic gun having a reciprocable bolt means and a hammer mechanism which comprises a hammer connected to rotate about a pivot, a firing pin striking surface on the hammer, and a pivot about which a pivotable strut moves, said pivot for the strut being on a side of the hammer firing pin striking surface which is remote from the hammer pivot, a bias means for urging the strut toward a firing position, the strut being arranged to be contacted by the bolt means to permit the bolt means to travel entirely rearwardly of the hammer to thereby cock the hammer, the strut holding the hammer out of the forward path of the bolt means to enable the bolt means to travel forwardly and thereby strip and chamber a cartridge.

2. A gun according to claim 1, wherein the bias means comprises a tube pivotably mounted at an end remote from the hammer, a compression spring inside the tube having one end thereof abutting the tube pivot, a shank at the end of the strut remote from the hammer, the shank extending inside the compression spring, and a stop surface at the confluence of the shank and the strut against which the end of the compression spring remote from the tube exerts force, whereby the force of the compression spring urges the shank to be reciprocable within the tube to rotate the hammer.

3. A (hammer mechanism) gun according to claim 1, wherein a portion of the hammer remote from the pivot thereof has a surface defining a radius extending through an approximate quadrant and the strut is mounted on the hammer so that the upper bolt means contacting surface thereof is substantially tangential to said radius.

4. A gun according to claim 1, wherein a pivot is provided about which a trigger is mounted, said trigger being associated with a sear having a lip for engaging with a corner on the hammer, the corner on the hammber being intermediate the respective pivots of the hammer and strut, whereby the lip and corner are arranged so that when the hammer is released the sear holds the hammer in a non-firing position and when the trigger is pulled the sear releases the hammer which is then urged by the bias means to a firing position.

5. A gun according to claim 4, wherein the trigger is integral with the sear.

6. A gun according to claim 4, wherein a latch is pivotally mounted on the trigger pivot, the latch having one surface arranged to abut the trigger, a further surface arranged to holdingly engage the hammer and a biassing means urging said one surface to be rotated into abutting relationship with the trigger.

7. A gun according to claim 6, wherein the biassing means is a compression spring.

8. A gun according to claim 6, wherein said further surface is hook shaped to engage with a receiving recess in the hammer.

9. A gun according to claim 8, wherein the receiving recess in the hammer is located between said corner and the pivot about which said strut pivots.

10. A gun according to claim 6, wherein the trigger and latch each have a respective tail portion located rearwardly on their common pivotable mounting and a compression spring is mounted in the tail portion of the trigger to extend toward the tail portion of the latch for exerting rotational effort thereupon.

* * * * *

UNITED STATES PATENT AND TRADEMARK OFFICE

CERTIFICATE OF CORRECTION

PATENT NO. : 4,522,106

DATED : June 11, 1985

INVENTOR(S) : Leroy J. Sullivan

It is certified that error appears in the above-identified patent and that said Letters Patent is hereby corrected as shown below:

On the title page Inventor's name should read

-- Leroy J. Sullivan --.

Column 9, line 1, delete "(hammer mechanism)".

Signed and Sealed this

*Twenty-first* Day of *January 1986*

[SEAL]

*Attest:*

DONALD J. QUIGG

*Attesting Officer*

*Commissioner of Patents and Trademarks*